US007193578B1

(12) United States Patent
Harris et al.

(10) Patent No.: US 7,193,578 B1
(45) Date of Patent: Mar. 20, 2007

(54) HORN ANTENNA ARRAY AND METHODS FOR FABRICATION THEREOF

(75) Inventors: Daniel W. Harris, Mount Laurel, NJ (US); Joseph W. Hahn, Clementon, NJ (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 11/245,831

(22) Filed: Oct. 7, 2005

(51) Int. Cl.
*H01Q 13/10* (2006.01)

(52) U.S. Cl. ..... 343/767; 343/786

(58) Field of Classification Search ..... 343/767, 343/770, 700 MS, 768, 790
See application file for complete search history.

(56) References Cited

U.S. PATENT DOCUMENTS 4,575,726 A * 3/1986 Gounder ..... 343/756
4,743,916 A * 5/1988 Bengeult ..... 343/785
6,154,182 A * 11/2000 McLean ..... 343/773
6,667,721 B1 * 12/2003 Simonds ..... 343/773
6,891,511 B1 5/2005 Angelucci ..... 343/767
2002/0190891 A1 * 12/2002 Viana et al. ..... 342/27

* cited by examiner

*Primary Examiner*—Trinh Dinh
*Assistant Examiner*—Huedung Mancuso
(74) *Attorney, Agent, or Firm*—Duane Morris,LLP

(57) ABSTRACT

A method for making a horn antenna array includes the steps of making first and second equal-size printed-circuit half-horn-elements, and offset-juxtaposing element pairs to make horn elements having a dielectric lip or step. A ground plane defining mutually intersecting crossed slot sets is loaded with horn elements with their lips interlocking near the slot crossings, to define the horn antenna array. The horn elements can be fed by pins extending through portions of the ground plane and into an aperture adjacent the feed elements of the horn elements. Electrical connections are made by fusion joining after the array is assembled.

19 Claims, 9 Drawing Sheets

PLASTIC FACEPLATE
BOTTOM ISOMETRIC VIEW
300a
300Is
300

MOLDED IN RF CONNECTOR SHROUDS
METALIZED PLASTIC FACEPLATE
TOP ISOMETRIC VIEW
300US
300S2
300S2
300L
300L
3c
300 Si
3c
300

RF PINS
SLOTS FOR ELEMENT ATTACHMENT

INTERLACED PATTERN OF ELEMENTS
LAYER 1
LAYER 2
CUTOUT 10a FOR RF PIN
INTERLACED JOINT WITHOUT SOLDER
STEP 15 IN BOARDS
15
BOTTOM VIEW W/O SOLDER

SOLDER FILLET
BOTTOM VIEW W/SOLDER
INTERLACED JOINT 550 WITH SOLDER 10
15
500
TOP ISOMETRIC VIEW

SOLDER JOINT ENTIRE LENGTH OF ELEMENTS
BOTTOM ISOMETRIC VIEW

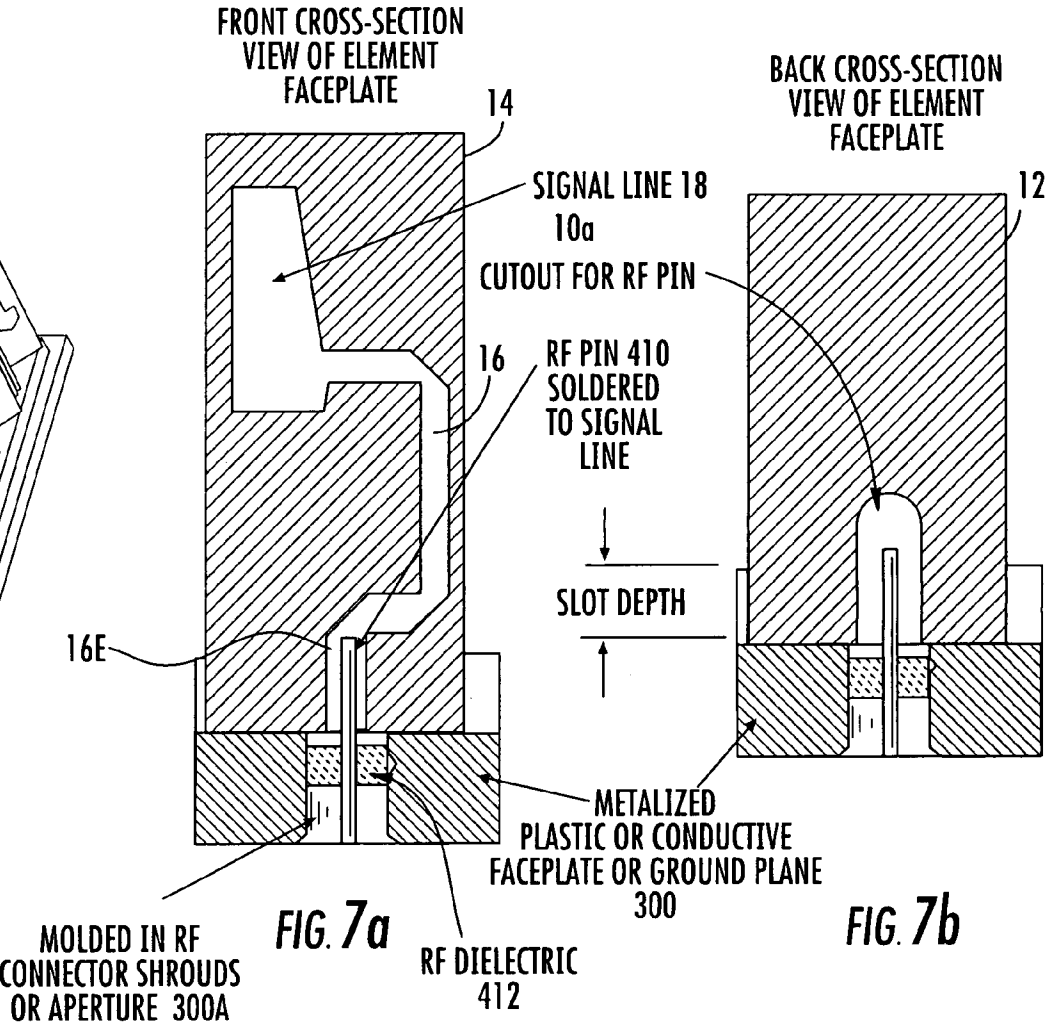
FIG. 7b
FIG. 7a
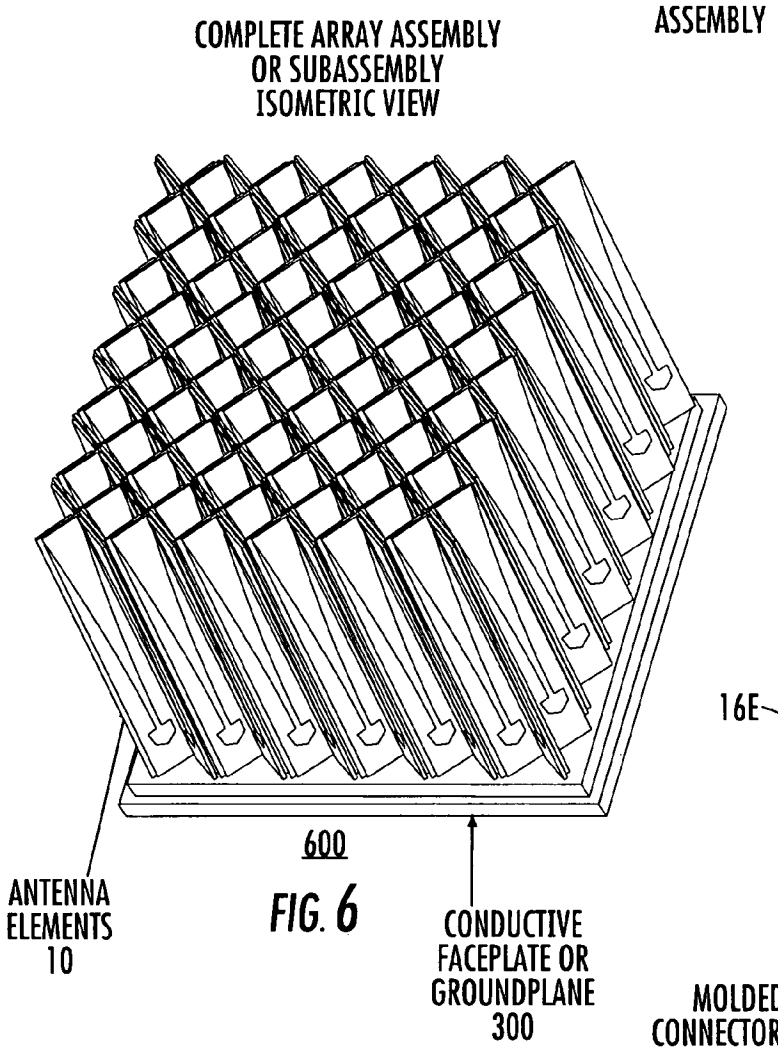
FIG. 6

FUNNEL
810
12
14
HORN ANTENNA ELEMENTS 10
812
812
FRONT CROSS-SECTION VIEW OF ASSEMBLY WITH SOLDER FIXTURE
ASSEMBLY WITH SOLDER FIXTURE
SOLDER BALLS 814
12
14
GRAPHITE SOLDER FIXTURE 810
CHAMFERED ALIGNMENT FEATURES
600

ASSEMBLY WITH SOLDER FIXTURE ISOMETRIC VIEW
810
300
600
812
812
10

HORN ANTENNA ARRAY AND METHODS FOR FABRICATION THEREOF

GOVERNMENTAL INTEREST

This invention was made with government support under Contract/Grant SOMA 1TL391S01T00. The United States Government has a non-exclusive, non-transferable, paid-up license in this invention.

FIELD OF THE INVENTION

This invention relates to array antennas and to methods for making such antennas.

BACKGROUND OF THE INVENTION

Those skilled in the arts of antenna arrays and beamformers know that antennas are transducers which transduce electromagnetic energy between unguided- and guided-wave forms. More particularly the unguided form of electromagnetic energy is that propagating in "free space," while guided electromagnetic energy follows a defined path established by a "transmission line" of some sort. Transmission lines include coaxial cables, rectangular and circular conductive waveguides, dielectric paths, and the like. Antennas are totally reciprocal devices, which have the same beam characteristics in both transmission and reception modes. For historic reasons, the guided-wave port of an antenna is termed a "feed" port, regardless of whether the antenna operates in transmission or reception. The beam characteristics of an antenna are established, in part, by the size of the radiating portions of the antenna relative to the wavelength. Small antennas make for broad or nondirective beams, and large antennas make for small, narrow or directive beams. When more directivity (narrower beamwidth) is desired than can be achieved from a single antenna, several antennas may be grouped together into an "array" and fed together in a phase-controlled manner, to generate the beam characteristics characteristic of an antenna larger than that of any single antenna element. The structures which control the apportionment of power to (or from) the antenna elements are termed "beamformers," and a beamformer includes a beam port and a plurality of element ports. In a transmit mode, the signal to be transmitted is applied to the beam port and is distributed by the beamformer to the various element ports. In the receive mode, the unguided electromagnetic signals received by the antenna elements and coupled in guided form to the element ports are combined to produce a beam signal at the beam port of the beamformer. A salient advantage of sophisticated beamformers is that they may include a plurality of beam ports, each of which distributes the electromagnetic energy in such a fashion that different beams may be generated simultaneously.

Antenna arrays are becoming increasingly important for communication and sensing. Those skilled in the design of antenna arrays know that the physical size of the elemental antennas of the array and their physical spacing in an array is an inverse function of frequency, with higher frequencies requiring smaller antenna elements and spacings than lower frequencies. As it so happens, increasing bandwidths required for more sophisticated communications and sensing tend to result in the use of higher frequencies, with the result that the fabrication of antenna arrays tends toward fabrication of small structures arrayed with small inter-element spacings.

The problems associated with the fabrication of antenna arrays is exacerbated by the need which often occurs for the ability to radiate dual polarizations, which is to say the ability to selectively radiate or receive mutually orthogonal polarizations of electromagnetic energy. The ability to receive (and to transmit) significantly in a given polarization depends upon having a "radiating aperture" in the direction of the electric field of the desired polarization. Thus, an antenna, in order to be an effective, should have a finite (non-zero) dimensions (in terms of wavelength) in the direction of the electric field to be transduced. When dual polarization (or corresponding elliptical or circular polarization) is desired, the radiating elements must extend significantly in two mutually orthogonal directions.

The prior art relating to horn antenna arrays and their fabrication includes U.S. Pat. No. 6,891,511, issued May 10, 2005 in the name of Angelucci. The Angelucci method for fabricating an antenna array includes the placing an array of clips into a ground plane. The method also includes the "printing" of an array of electrically conductive horn antenna elements on a first dielectric circuit board (or set thereof), which first board(s) define a slot adjacent each antenna element. Such a printed board has a significant dimension only in one plane, so can only be an efficient radiator in the plane of the board. The first board(s) are mounted in a mutually parallel manner on the array of clips. A second dielectric board (or set of boards) is printed with similar conductive horns, but its slots are arranged to mate with the slots of the first board(s). The second boards are mounted onto the clips and the first board(s) so that, when mated, the second boards are mutually orthogonal to the first boards, and the horns form a rectangular array in which the antenna elements of the first boards radiate in a first polarization, and the antenna elements of the second boards radiate in a second polarization, orthogonal to the first polarization. The physical arrangement of the clips tends to stabilize the antenna array against deformation attributable to dimensional stability deviations of the dielectric materials.

Improved or alternative antenna arrays and methods for fabrication thereof are desired.

SUMMARY OF THE INVENTION

A method according to an aspect of the invention is for making a horn antenna. The method comprises the steps of fabricating a dielectric first board defining first and second broad sides, and which may define a board thickness, and also having at least a first transverse dimension adjacent a feed end of the first board. The first board defines an electrically conductive horn on the first broad side thereof, and a feed structure on the second broad side thereof adjacent the feed end of the first board. The feed structure includes a strip conductor adjacent the feed end of the first board. The method includes the step of fabricating a dielectric second board defining first and second broad sides, possibly also defining a board thickness, and also having at least the first transverse dimension adjacent a feed end of the second board. The second board defines on the first broad side thereof at electrically conductive horn including a feed region adjacent the feed end of the second board. The second board defines an aperture or slot which is registered with the strip conductor when the second broad side of the first board is offset-juxtaposed with the second broad side of the second board. The second broad side of the first board is offset-juxtaposed with the second broad side of the second board, with the strip conductor feed structure adjacent the aperture, and an offset or step between lateral edges of the first and second boards, to thereby generate a single horn element. This step or offset may be equal in magnitude to the thickness. A particular mode of this method comprises the further step of affixing the offset-juxtaposed second broad side of the first board to the second broad side of the second board. The step of affixing may include application of fluid adhesive substance, which may be a hardenable fluid adhesive substance such as curable resin, to at least one of the second broad side of the first board and to the second broad side of the second board. The step of affixing the offset-juxtaposed second broad side of the first board to the second broad side of the second board may comprise the step of fusion-bonding the offset-juxtaposed second broad side of the first board to the second broad side of the second board.

Another method according to an aspect of the invention for making a horn antenna comprises the steps of procuring a dielectric first board defining first and second broad sides and a board thickness, and also having at least a first transverse dimension adjacent a feed end of the first board. The first board which is procured defines a conductive horn on the first broad side thereof and a feed structure on the second broad side thereof adjacent the feed end of the first board. The feed structure of the first board includes a strip conductor adjacent the feed end of the first board. The method also includes the step of procuring a dielectric second board defining first and second broad sides and a board thickness, and also having at least the first transverse dimension adjacent a feed end of the second board. The second board defines on the first broad side a conductive horn including a feed region adjacent the feed end of the second board, and the second board defines an aperture which is registered with the strip conductor when the second broad side of the first board is offset-juxtaposed with the second broad side of the second board. The second broad side of the first board is juxtaposed with the second broad side of the second board, with the strip conductor feed structure adjacent the aperture, to thereby generate a horn element. An electrically conductive support plate is procured, which defines first and second broad surfaces, and a plurality of elongated slots depressed below the first broad surface. The plurality of slots includes first and second sets of slots, the directions of elongation of which are mutually orthogonal. The individual slots of the first and second sets each define a width accommodating the combined thicknesses of the first and second boards. The individual slots of the first and second sets are mutually parallel and are spaced apart by a dimension at least equal to the transverse dimension. The conductive support plate further bears a plurality of electrically conductive pins which are electrically insulated from the support plate. The pins extend at least partially through the support plate between the first and second broad sides, and projecting into the slots at locations registered with the strip conductors when the horn elements are mounted in the slots in such a manner that the pins lie adjacent the corresponding strip conductor. The feed end of the horn element is inserted into a corresponding slot of the conductive support plate with the strip conductor registered to be adjacent the corresponding pin. The pin is electrically connected or bonded, as by fusing or soldering, to the strip conductor. In a particular mode of this method, the step of juxtaposing the second broad side of the first board with the second broad side of the second board, with the strip conductor feed structure adjacent the aperture, to thereby generate a horn element, further comprises the step of bonding the second broad side of the first board with the second broad side of the second board. In another mode of the method, the step of bonding comprises the step of application of the liquid state of an adhesive substance, which may be a curable resin.

A method according to an aspect of the invention is for making a horn array. The method comprises the steps of procuring a dielectric first board defining first and second broad sides, a board thickness, and first and second lateral edges, and also having at least a first transverse dimension between the lateral edges at a location adjacent a feed end of the first board. The first board defines an electrically conductive horn on the first broad side thereof and a feed structure on the second broad side thereof adjacent the feed end of the first board. The feed structure includes a strip conductor adjacent the feed end of the first board. The method also includes the procuring of a dielectric second board defining first and second broad sides, a board thickness, and first and second lateral edges, and also having at least the first transverse dimension between those lateral edges adjacent a feed end of the second board. The second board defines on the first broad side a conductive horn including a feed region adjacent the feed end of the second board. The second board defines an aperture which is registered with the strip conductor when the second broad side of the first board is offset-juxtaposed with the second broad side of the second board. The second broad side of the first board is offset-juxtaposed with the second broad side of the second board, with the strip conductor feed structure adjacent the aperture, and with the lateral edges offset by the thickness, to thereby generate a horn antenna element. The steps of procuring a dielectric first board, procuring a dielectric second board, and offset-juxtaposing of the boards are repeated, until at least four horn antenna elements are available. A conductive support plate is procured, which defines first and second broad surfaces, and a plurality of elongated slots depressed below the first broad surface. The plurality of slots includes first and second sets of slots, the directions of elongation of which are mutually orthogonal. The individual slots of the first and second sets each define a width accommodating the combined thicknesses of the first and second boards of a horn antenna element. The individual slots of the first and second sets are mutually parallel and spaced apart by a dimension about equal to the sum of the transverse dimension plus the thickness of one of the first and second boards. The conductive support plate further supports a plurality of electrically conductive pins, each of which is electrically insulated from the support plate. The pins extend at least partially through the support plate, between the first and second broad sides, and project into the slots at locations registered with the strip conductors when the horn elements are mounted in the slots in such a manner that the pins lie adjacent the corresponding strip conductor. The feed ends of at least first, second, third, and fourth of the horn antenna elements are inserted into a pair of mutually orthogonal corresponding slots of the conductive support plate with the strip conductors registered to be adjacent the corresponding pins and with the offsets of the first, second, third and fourth horn antenna elements mating. The pins are electrically connected to the strip conductors.

Another method for making a horn array according to an aspect of the invention comprises the steps of procuring a dielectric first board defining first and second broad sides, a board thickness, and first and second lateral edges, and also having at least a first transverse dimension adjacent a feed end of the first board, the first board defining a conductive-slot horn on the first broad side thereof and a feed structure on the second broad side thereof adjacent the feed end of the first board. The feed structure includes a strip conductor adjacent the feed end of the first board. A dielectric second board is procured, which defines first and second broad sides, a board thickness, and first and second lateral edges, and which also defines at least the first transverse dimension adjacent a feed end of the second board. The second board defines on the first broad side thereof a conductive-slot horn including a feed region adjacent the feed end of the second board. The second board defines an aperture which is registered with the strip conductor when the second broad side of the first board is offset-juxtaposed with the second broad side of the second board. This method also includes the step of offset-juxtaposing the second broad side of the first board with the second broad side of the second board, with the strip conductor feed structure adjacent the aperture, and with the lateral edges offset by the thickness, to thereby generate a conductive-slot horn antenna element defining a radiating end opposite to the feed end. The steps of procuring a dielectric first board, procuring a dielectric second board, and offset-juxtaposing of the boards are repeated, until at least four horn antenna elements are available. A conductive support plate is procured, which defines first and second broad surfaces, and a plurality of elongated slots depressed below the first broad surface. The plurality of slots includes first and second sets of slots, the directions of elongation of which are mutually orthogonal. The individual slots of the first and second sets define a width accommodate the combined thicknesses of the first and second boards of a horn antenna element. The individual slots of the first and second sets are mutually parallel and are spaced apart by a dimension about equal to the sum of the transverse dimension plus the thickness of one of the first and second boards. The conductive support plate further supports a plurality of electrically conductive pins, which are electrically insulated from the support plate. The pins extend at least partially through the plate between the first and second broad sides, and project into the slots at locations registered with the strip conductors when the horn elements are mounted in the slots in such a manner that the pins lie adjacent the corresponding strip conductors. The feed end of at least first, second, third, and fourth of the conductive-slot horn antenna elements are inserted into a pair of mutually orthogonal corresponding slots of the conductive support plate, with the strip conductors registered to be adjacent the corresponding pins and with the offsets of the first, second, third and fourth horn antenna elements mating or interlocked. The pins are electrically connected to the strip conductors and the conductive portions of the conductive slot horns are electrically connected to adjacent ones of the conductive portions of the conductive slot horns, to thereby define an antenna array including two pairs of mutually orthogonal conductive horn antenna elements. In a particular mode of this method for making an array, a further step is performed between the steps of inserting the feed end of a horn element and electrically connecting pins, which further step includes affixing a jig to the radiating end of the conductive horn antenna elements toehold the radiating ends of the horn antenna elements in the same dimensional relationship as that provided to the feed ends by the slots of the support plate. In a particularly desirable mode of this method, the jig includes a material, such as graphite, which is not wetted by a fusion material, and the step of electrically connecting further comprises the step of heating the two pairs of mutually orthogonal conductive horn antenna elements and the conductive support plate in the presence of fusion material, such as solder. Ideally, the steps of (a) procuring a dielectric first board, (b) procuring a dielectric second board, (c) offset-juxtaposing to thereby generate a conductive-slot horn antenna element, (d) repeating, (e) procuring a conductive support plate, and (f) inserting the feed end are repeated, until slot locations having the pins are all populated, and only when all slot locations are so populated performing the step of electrically connecting.

BRIEF DESCRIPTION OF THE DRAWING

FIG. 6 is an isometric view of a portion of a horn array antenna made according to a method of the invention;

FIG. 7*a* is a front cross-sectional view of a portion of a horn element mounted in the ground plane of FIG. 4*a*, and FIG. 7*b* is a rear or back cross-section thereof.

DESCRIPTION OF THE INVENTION

By contrast with the arrangement of the abovementioned Angelucci U.S. Pat. No. 6,891,511 patent, a method according to an aspect of the invention fabricates printed-circuit-based horn antenna elements individually, assembles them to a ground plane individually or in groups, and then makes the physical attachments.

Figure 1A:
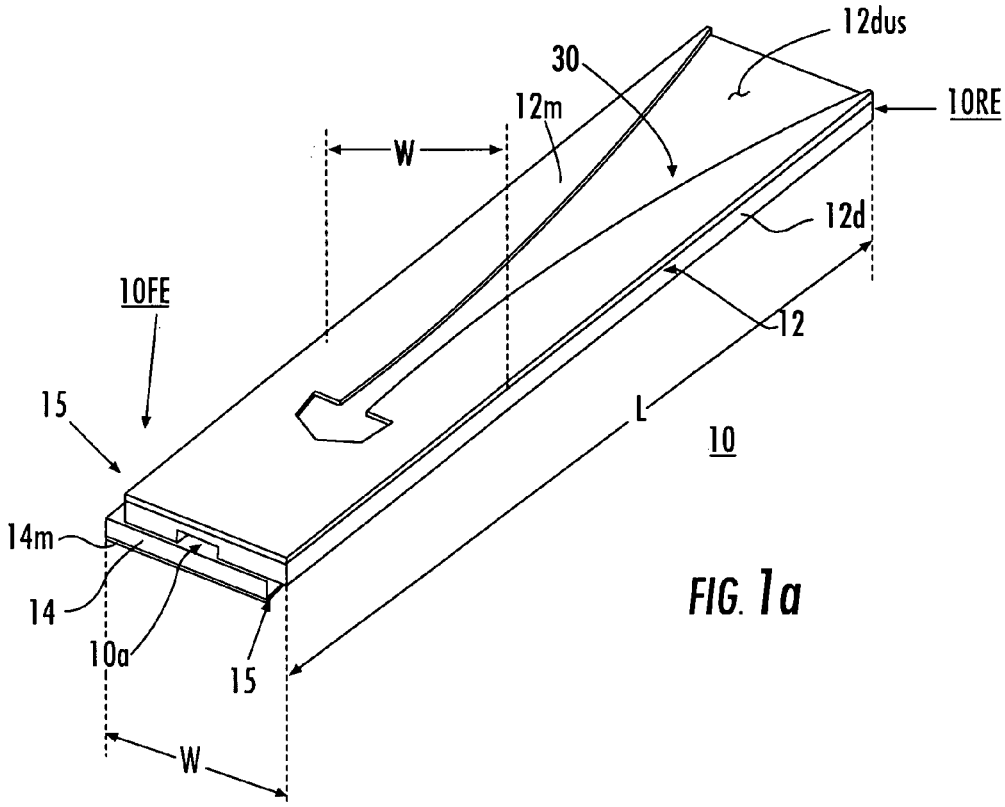
FIG. 1*a* is a simplified perspective or isometric view of a horn antenna element according to an aspect of the invention, including juxtaposed printed circuit boards.
Figure 1B:
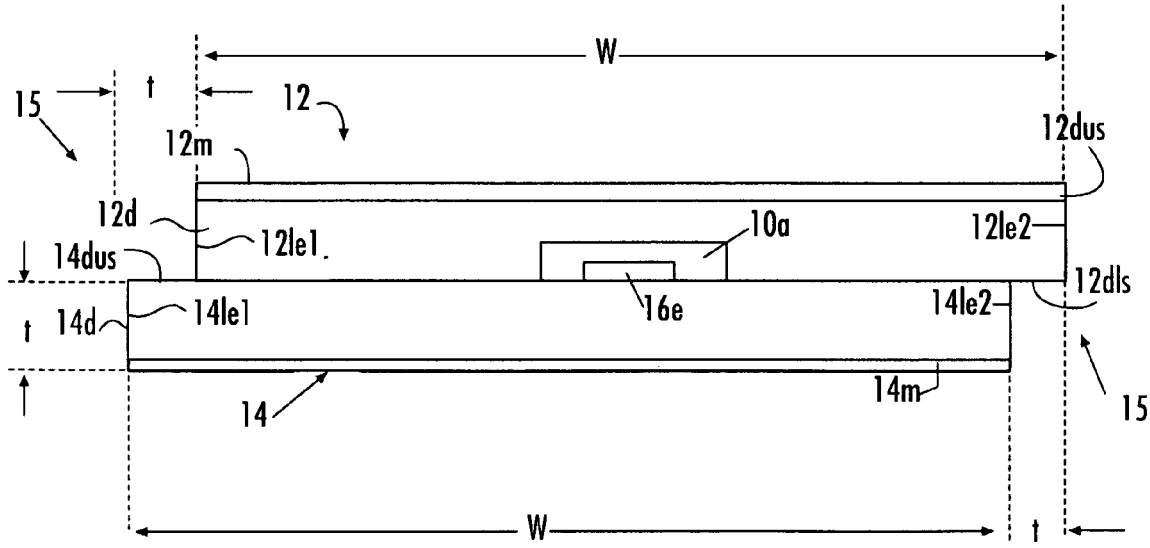
FIG. 1*b* is an end view thereof.

FIG. 1*a* is a simplified perspective or isometric view of a single horn antenna element 10 according to an aspect of the invention. Antenna 10 defines a feed end 10FE, a radiating end 10RE, and an overall length L. In FIG. 1*a*, the antenna element 10 is comprised of two juxtaposed "printed-circuit" or dielectric boards, namely an upper board 12 and a lower board 14, each having width W. Each of the upper board 12 and lower board 14 defines a feed end 12FE and 14FE, respectively, and a radiating end 12RE and 14RE, respectively. FIG. 1*b* illustrates a feed-end view of the arrangement of FIG. 1*a*. Upper board 12 includes two portions, namely a dielectric board portion 12*d* and a metallic portion 12*m*. The upper surface of dielectric board 12*d* is designated as 12*dus*, and the lower surface is designated 12*dls*. In FIG. 1*b*, upper board 12 has left and right lateral edges 12*le*1 and

12*le*2. As illustrated in FIGS. 1*a* and 1*b*, the metallic portion 12*m* of printed-circuit board 12 overlies the upper surface 12*dus* of the dielectric portion of upper board 12. The metallic portion 12*m* is cut out to define a metal-free "through aperture" designated generally as 20 and an associated horn-defining slot 30, as described in copending patent application Ser. No. 10/830,797, filed Apr. 23, 2004 in the name of Hsu et al. As illustrated in FIGS. 1*a* and 1*b*, upper printed-circuit board 12 partially overlies lower printed-circuit board 14. More particularly, the lower surface 12*dls* of board 12 overlies and is generally juxtaposed with upper surface 14*dus* of lower board 14. As also illustrated in FIGS. 1*a* and 1*b*, an aperture or slot 10*a* is defined in the near end of juxtaposed boards 12 and 14.

The description herein includes relative placement or orientation words such as "top," "bottom," "up," "down," "lower," "upper," "horizontal," "vertical," "above," "below," as well as derivative terms such as "horizontally," "downwardly," and the like. These and other terms should be understood as to refer to the orientation or position then being described, or illustrated in the drawing(s), and not to the orientation or position of the actual element(s) being described or illustrated. These terms are used for convenience in description and understanding, and do not require that the apparatus be constructed or operated in the described position or orientation.

As illustrated in the end view of FIG. 1*b*, the overlap or juxtaposition of boards 12 and 14 is only partial, in that the overlap extends only over a width of W-2t. That is, the overlap portion is not the full width W of the boards, but is instead less by twice the thickness t of the boards. At the left in FIG. 1*b* the left lateral edge 14*le*1 of bottom board 14 extends beyond the left lateral edge 12*le*1 of upper board 12 by thickness t, and at the right lateral edge 12*le*2 of upper board 12 extends past the right lateral edge 14*le*2 of lower board 14, also by thickness t. The presence of the overlap results in a "step" or "offset" 15 adjacent each long edge of the structure 10.

Figure 2A:
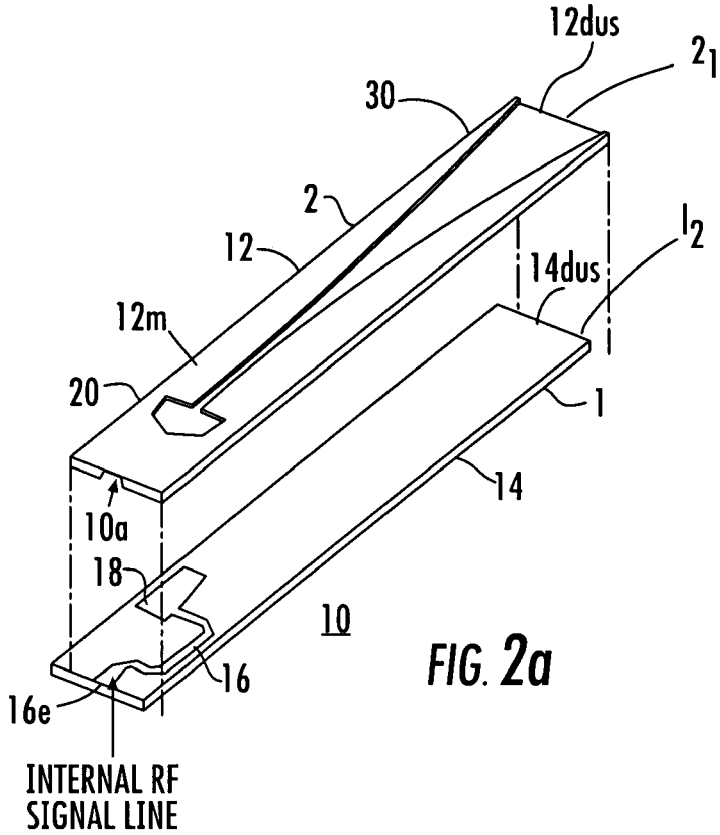
FIG. 2*a* is a simplified exploded view of the arrangement of FIGS. 1*a* and 1*b*.

FIG. 2*a* is an exploded view of the arrangement of FIGS. 1*a* and 1*b*, illustrating boards 12 and 14 exploded away from each other to illustrate some details of board 14. In FIG. 2*a*, board 14 can be seen to be similar in size to board 12. The near or upper side 14*dus* of board 14 bears a pattern of metallization, corresponding to the feed arrangement for the horn of the arrangement of the Hsu et al. patent. More particularly, the pattern of metallization includes a strip conductor 16 which is a portion of a feed transmission line terminating at an end location 16*e* adjacent the juxtaposed feed ends 12FE and 14FE of the boards 12 and 14. The pattern of metallization also includes a capacitive or load portion 18, also described by Hsu et al.

Figure 2B:
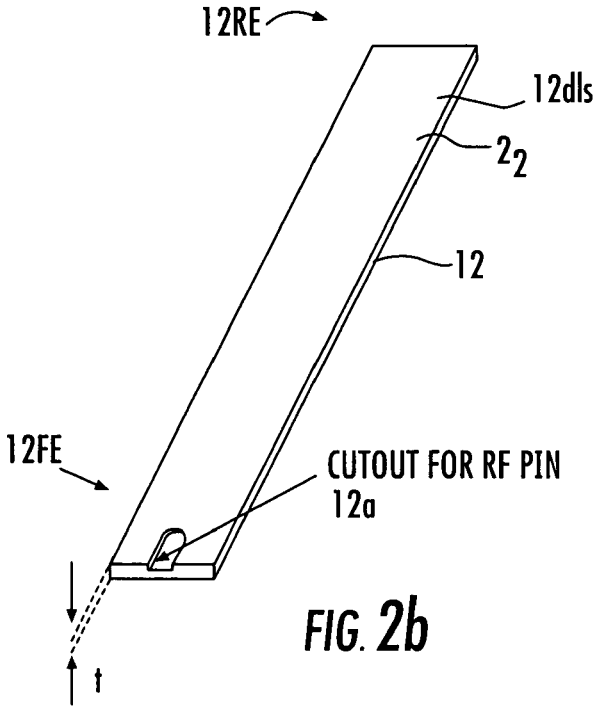
FIG. 2*b* illustrates the reverse side of the upper board of FIGS. 1*a* and 1*b*.
Figure 2C:
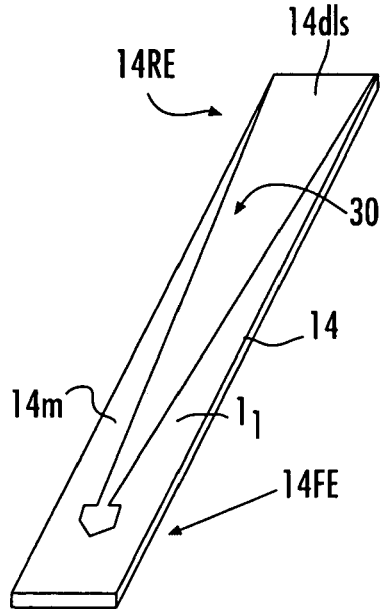
FIG. 2*c* illustrates the reverse side of the lower board of FIGS. 1*a* and 1*b;*

FIG. 2*b* is a perspective or isometric view of the lower or reverse side of printed-circuit board 12 of FIGS. 1 and 2*a*, illustrating the dielectric lower surface 12*dls*, and a slot 12*a* cut part-way through the thickness t of the board 12*d*. The location of slot 12*a* is selected so that it overlaps or is registered with strip conductor 16 near its end portion 16*e* when boards 12 and 14 are juxtaposed as illustrated in FIGS. 1*a* and 1*b*. The purpose of the resulting slot or aperture 10*a* is to provide access for a feed pin or center conductor (not illustrated in FIGS. 1*a*, 1*b*, 2*a*, 2*b*, or 2*c*) when the horn antenna element 10 is formed by the juxtaposition of boards 12 and 14. The feed pin will then be immediately adjacent the end portion 16*e* of feed conductor 16.

Figures 3A, 3B:
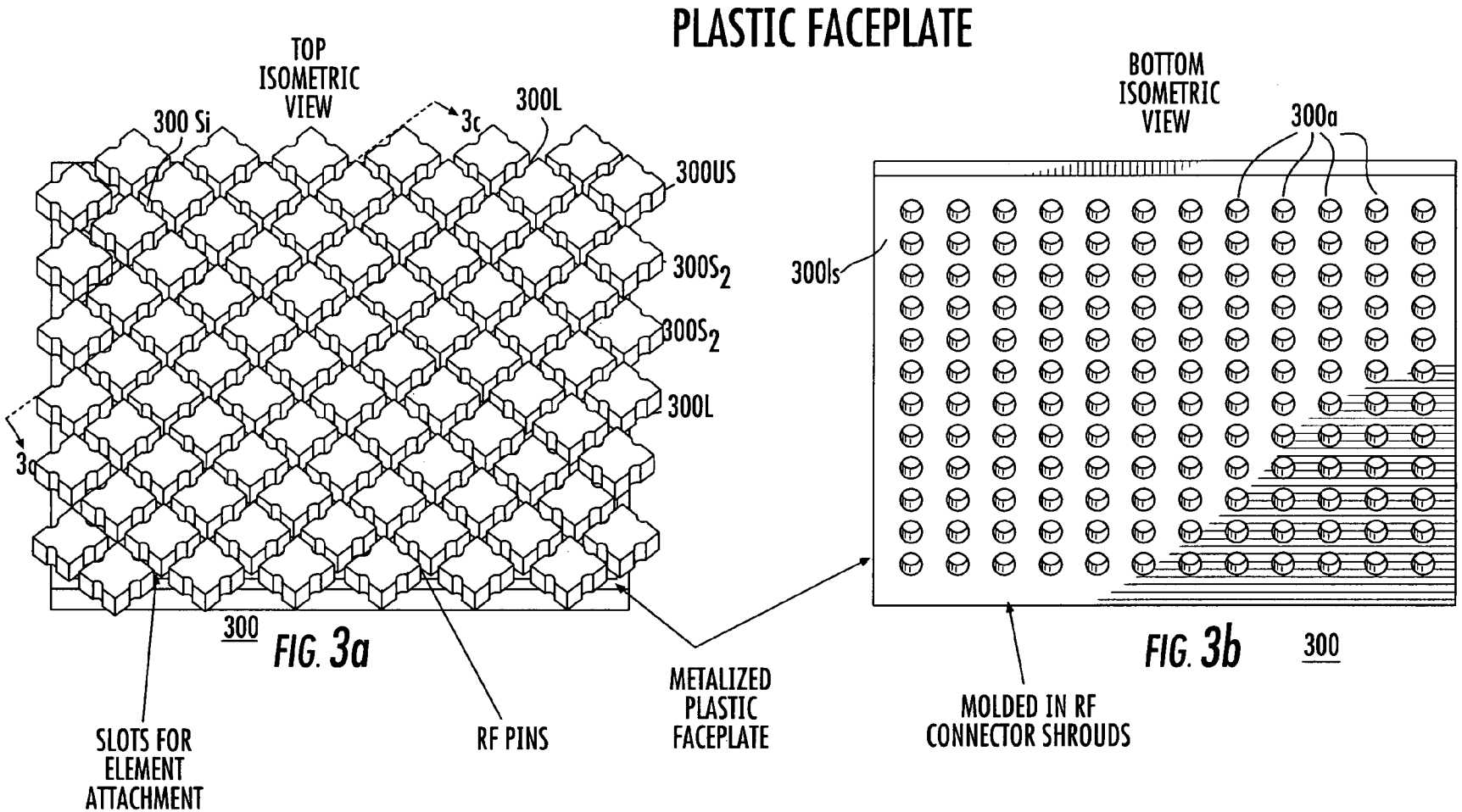
FIG. 3*a* is a simplified perspective or isometric view of the upper side of an electrically conductive ground plane useful with the antenna elements according to an aspect of the invention.
FIG. 3*b* is a view of the lower side of the structure of FIG. 3*a*.
Figure 3C:
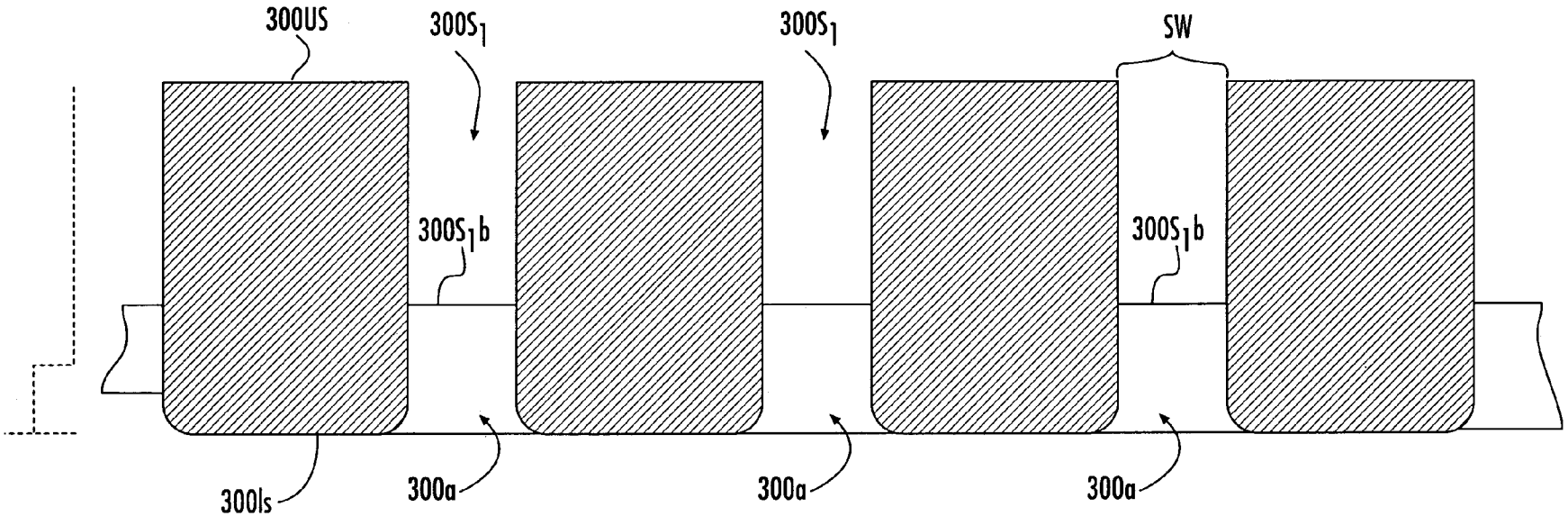
FIG. 3*c* is a cross-section of the structure of FIG. 3*a*.
Figure 3D:
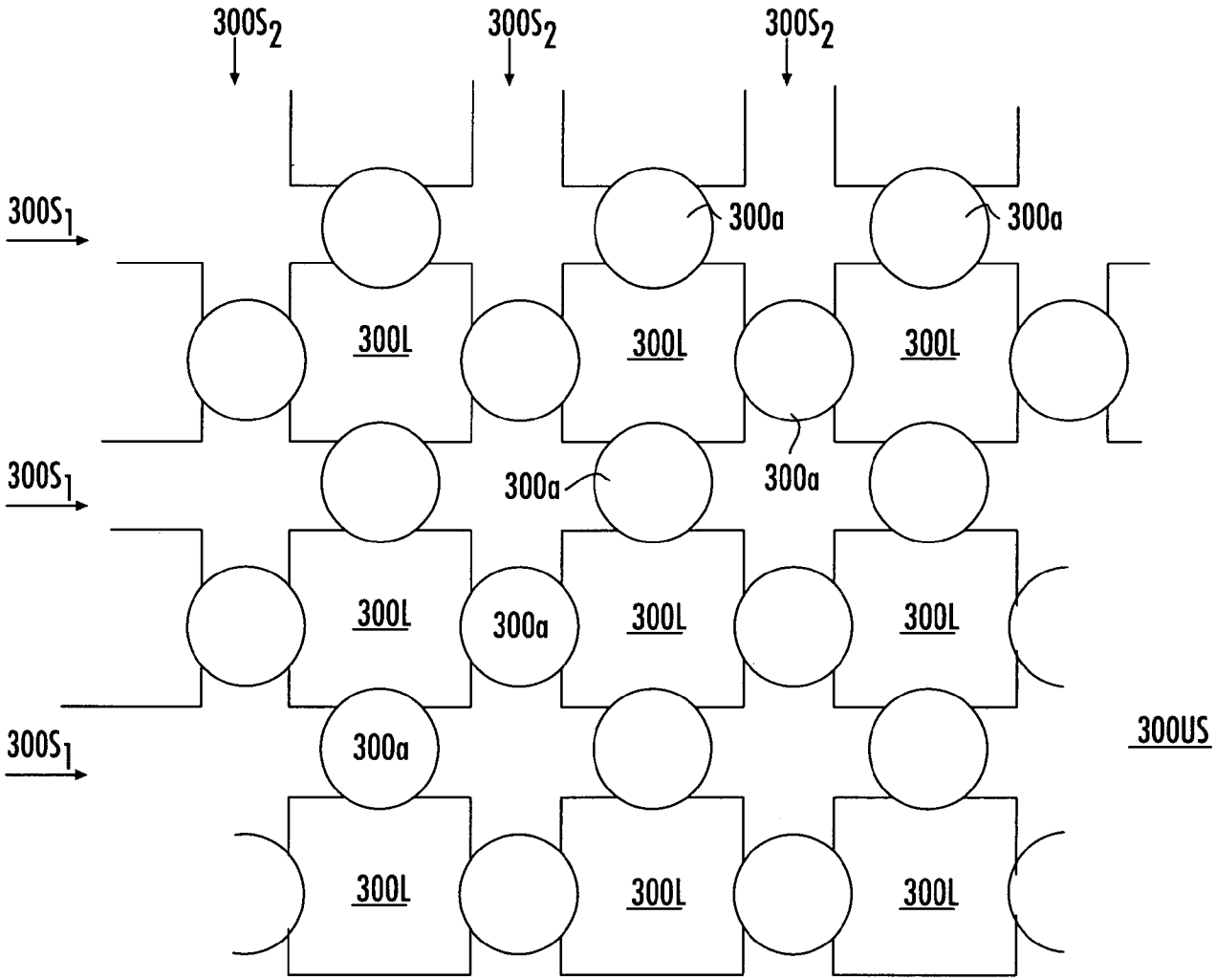
FIG. 3*d* is a plan view of the upper side of FIG. 3*a;*

FIGS. 3*a* and 3*b* illustrate the upper and lower sides, respectively, of a ground plane 300 suited for use with the horn antenna elements 10 as described in conjunction with FIGS. 1*a*, 1*b*, 2*a*, and 2*b*. FIG. 3*c* is a cross-sectional view of the structure 300 of FIG. 3*a* looking in the direction of section lines 3*c*–3*c*. FIG. 3*d* is a plan (overhead) view of the upper side of the structure 300 of FIG. 3*a*. The structure 300 should be electrically conductive, so it may be made from metal, as suggested by the hatching of FIG. 3*c*. However, in one embodiment of the invention the ground plane 300 is made from metallized plastic. The upper surface 300*us* of ground plane 300 defines a plurality of elongated slots, extending (having their directions of elongation) in a first direction along the surface, some of which slots are designated 300S1. The upper surface also defines a further plurality of elongated slots 300S2 with their directions of elongation orthogonal to those of slots 300S1. The pattern of crossed slots 300S1 and 300S2 creates a plurality of rectangular or square "lands," some of which are designated 300L in FIG. 3*a*.

The bottom view of ground plane 300 in FIG. 3*b* shows a pattern of through apertures 300*a* extending from lower surface 300*ls*. The apertures 300*a* extend through at least to the lower or bottom surfaces of the slots 300S1 and 300S2, and for ease of manufacture can extend completely through to the upper surface 300*us*. As illustrated in FIG. 3*c*, the lower surfaces of slots 300S1 are designated 300S1*b*. The apertures 300*a* form a rectangular pattern. The rectangular pattern of apertures 300*a* is registered with the sides of the lands 300L defined by the slots 300S1 and 300S2 on the upper side 300*us* of ground plane 300.

FIG. 3*d* is a plan view of the upper surface 300*us* of the ground plane 300 of FIGS. 3*a*, 3*b*, and 3*c*, showing how the mutually orthogonal slot sets 300S1 and 300S2 define a rectangular grid pattern defining lands 300L, and how the apertures 300*a* are centered on the sides of the lands 300L. As illustrated, the lands 300L are generally rectangular.

Figure 4:
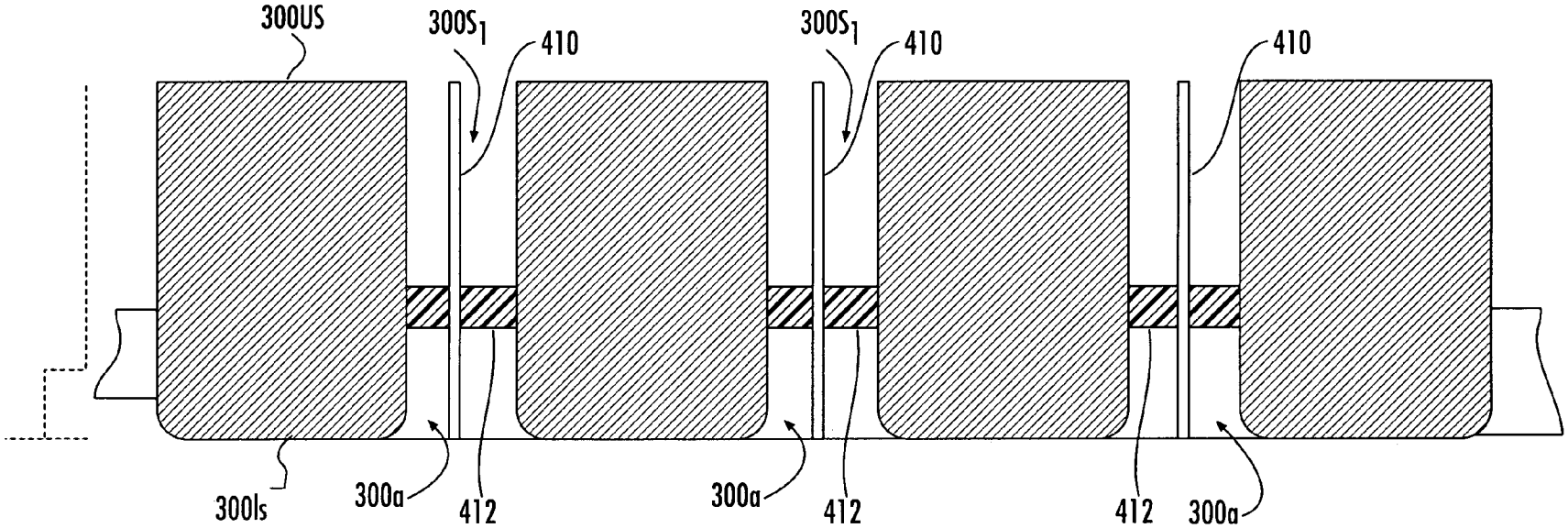
FIG. 4 is a cross-section similar to that of FIG. 3*c*, illustrating feed pins supported by the ground plane but isolated therefrom.

According to an aspect of the invention, the through apertures 300*a* are provided to act as connector shrouds for accepting coaxial feed connectors applied from the lower side of the ground plane 300. For this purpose, each aperture 300*a* is fitted with a pin having its axis oriented parallel with the axis of the aperture. In order to carry electromagnetic signals in a guided coaxial mode, the pin must be supported by dielectric. FIG. 4 is similar to FIG. 3*c*, with the addition of pins 410 extending axially through the apertures 300*a*, supported in position by dielectric pieces 412. The dielectric pieces 412 can be glass fused to both the interior surfaces of the apertures 300*a* and to the exteriors of the pins 410, or they can be any other convenient dielectric support. Naturally, the dimensions of the pins 412 and the interior diameters of the apertures 300*a* at locations near the lower surface 300*ls* of ground plane 300 must be selected to mate with a corresponding connector, preferably an inexpensive standard connector type such as SMA. The diameter of the pins 410 near the upper side 300*us* of the ground plane 300 should be selected to provide a tight or interference fit into the aperture 10*a* in the feed end 10*fe* of the antenna 10 of FIG. 1. Ideally, the same diameter is selected to meet both these requirements. The projection of the pins 410 into the slots 300S1 or 300S2 of FIG. 4 is selected to extend into the aperture 10*a*, but not to bottom therein.

According to an aspect of the invention, the two dielectric halves of each horn antenna are fastened together in the offset-juxtaposed manner illustrated in FIG. 1*a*, as by fusion bonding or welding, or by application of adhesive. If adhesive is used, it can be applied in liquid form and allowed to harden or cure. A suitable adhesive material may be epoxy resin. The fusion bonding or welding or the adhesive is performed or applied, as applicable, to those portions of the lower surface 12*dls* of board 12 and of the upper surface 14*dus* of board 14 which are juxtaposed as illustrated in FIGS. 1*a* and 1*b*. The conjoined board portions 12 and 14 together form a single horn antenna 10 capable of being fed at the feed end 10FE and radiating at the radiating end 10RE (remembering that the antenna is reciprocal in its operation).

In order to make an array antenna according to an aspect of the invention, a plurality of individual horn antennas such as 10 of FIGS. 1*a* and 1*b* are produced or procured. A baseplate or ground plane 300 similar to that of FIGS. 3*a*, 3*b*, 3*c*, and 3*d* is also procured, with pins inserted as illustrated in FIG. 4.

Figures 5A, 5B, 5C, 5D:
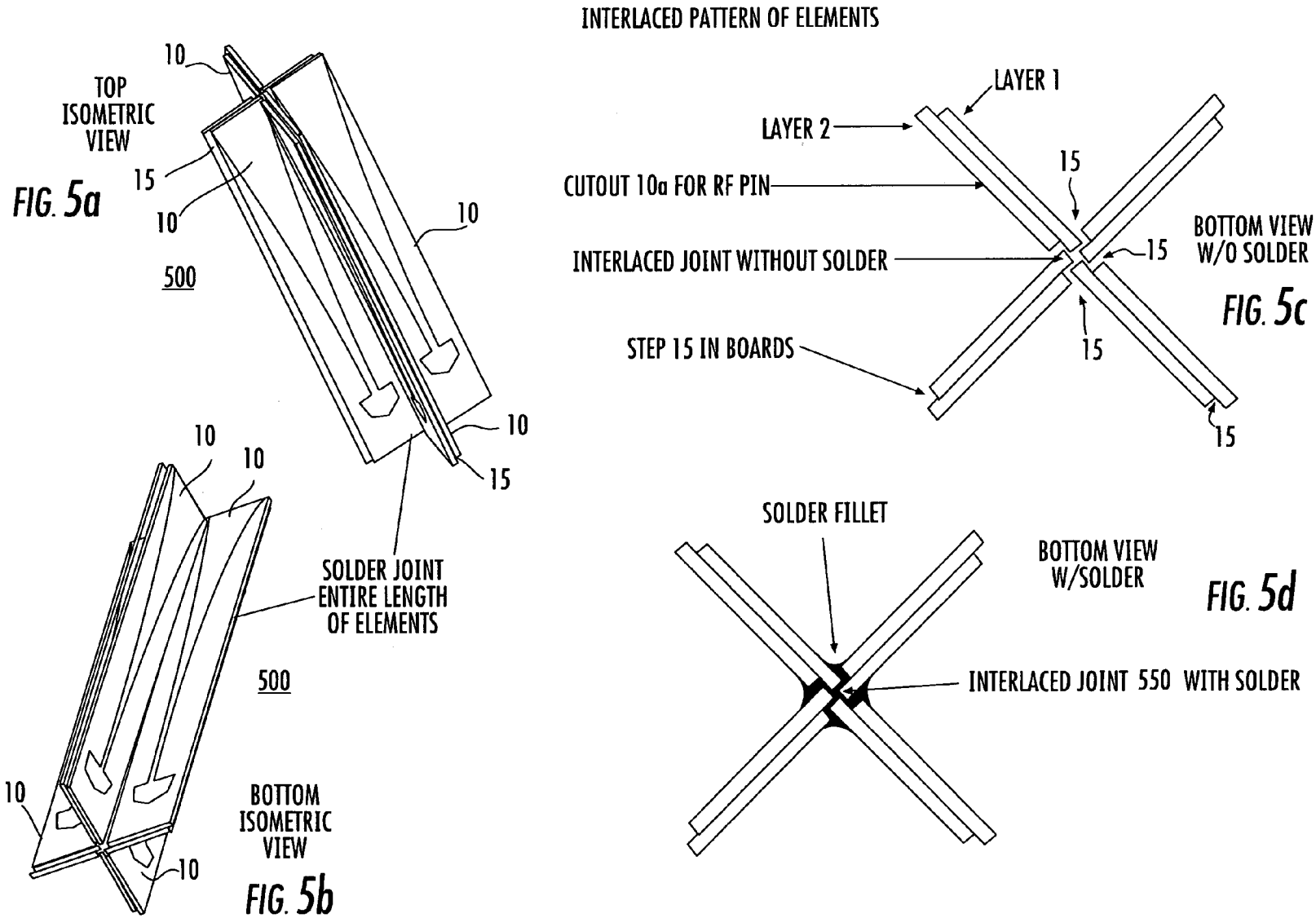
FIGS. 5*a* and 5*b* are top and bottom, respectively, isometric view of an assemblage of four horn antenna elements such as the one illustrated in FIG. 1.
FIG. 5*c* is an end or plan view of the structure of FIG. 5*a* before the performance of a fusing step.
FIG. 5*d* is similar to FIG. 5*c* after the fusion step.

The principles by which the individual horn antennas such as 10 of FIGS. 1*a* and 1*b* are arrayed are illustrated with the aid of FIGS. 5*a*, 5*b*, 5*c*, and 5*d*. FIG. 5*a* is a top isometric view of an assembly 500 of four horns 10, FIG. 5*b* is a bottom isometric view of the assembly of FIG. 5*a*, and FIGS. 5*c* and 5*d* are bottom views of an assembly 500 of four horn antennas 10 of FIGS. 5*a* and 5*b* at different stages of fabrication of the array. In order to fabricate the horn antenna array according to an aspect of the invention, each individual horn antenna 10 is conceptually juxtaposed with three other like horn antennas 10, with their steps or offsets 15 linked to form an "X" shape in end view, as illustrated in FIG. 5*c*. The four juxtaposed horns are then inserted into a slot crossing of the ground plane, as for example at the crossing of slots such as 300S1 and 300S2 of FIG. 3*a*. Additional four-horn assemblages 500 are added to the ground plane 300, fitting their steps 15 into the steps 15 of already-added four-horn assemblages 500, to form a complete horn array structure 600, at least a portion of which has the general appearance illustrated in FIG. 6. While it is conceptually appealing to view the assembly of array 600 in this manner, a possibly more practical technique is to use pick-and-place machinery to pick up individual horn antennas 10, and to individually place them in open slot positions in the baseplate. Pick-and-place machinery is well known and widely used, and those skilled in the art know how to use the technique.

During the assembly of the individual horn antenna elements 10 into the structure 600 of FIG. 6, the pick-and-place, whether performed by hand or by machinery, must be such as to fit the appropriate one of the pins 410 of FIG. 4 into the aperture 10*a* in the feed end 10FE of the corresponding horn antenna 10. FIG. 7*a* illustrates the relationship which should be maintained between a feed pin 410 and the feed conductor portions 16*e* and 16 of a dielectric board 14, and FIG. 7*b* illustrates the relationship which should be maintained between the feed pin 410 and the aperture slot 10*a* of board 12. In general, the pin 410 must be juxtaposed with, and preferably centered on, conductor portion 16*e*. Also, the pin 410 should not "bottom" in slot 10*a*, lest its presence prevent the horn antenna 10 from being held in its correct position.

Once all the pick-and-place has been accomplished to form a structure 600 similar to that of FIG. 6, reflow soldering (or possibly other fusion jointing) is performed on the entire assemblage. For this purpose, portions of the metal which are to be fused or soldered are "tinned" before assembly. Those skilled in the art know that tinning refers to pre-coating with a material which facilitates the fusion bonding process. The pre-tinned assemblage 600 is placed in a hot environment until the fusion material melts and flows, with the result that surface tension effects cause the various portions of the fusion material to fuse together. A bottom view of four mutually adjacent horn antenna elements 10 is illustrated in FIG. 5*d*, with the result of the reflow soldering or fusion illustrated as an interlaced joint 550 with solder. The assemblage is then removed from the heat and allowed to cool, with the result that the structure 600 becomes monolithic or one piece.

It will be noted that the various horn antennas 10 which are initially assembled to the baseplate or ground plane, before the soldering or fusion to make a monolithic structure, are held only at their bottoms by virtue of insertion of their feed ends into the slots of the baseplate. This may allow some play at the radiating ends of the horns as assembled into the array, which in turn may tend produce imperfect results. According to another aspect of the invention, a jig or fixture is assembled onto the radiating ends of the horn antennas assembled into the array, to thereby fix the radiating ends of the horn antennas as well as the feed ends.

Figures 8A, 8B:
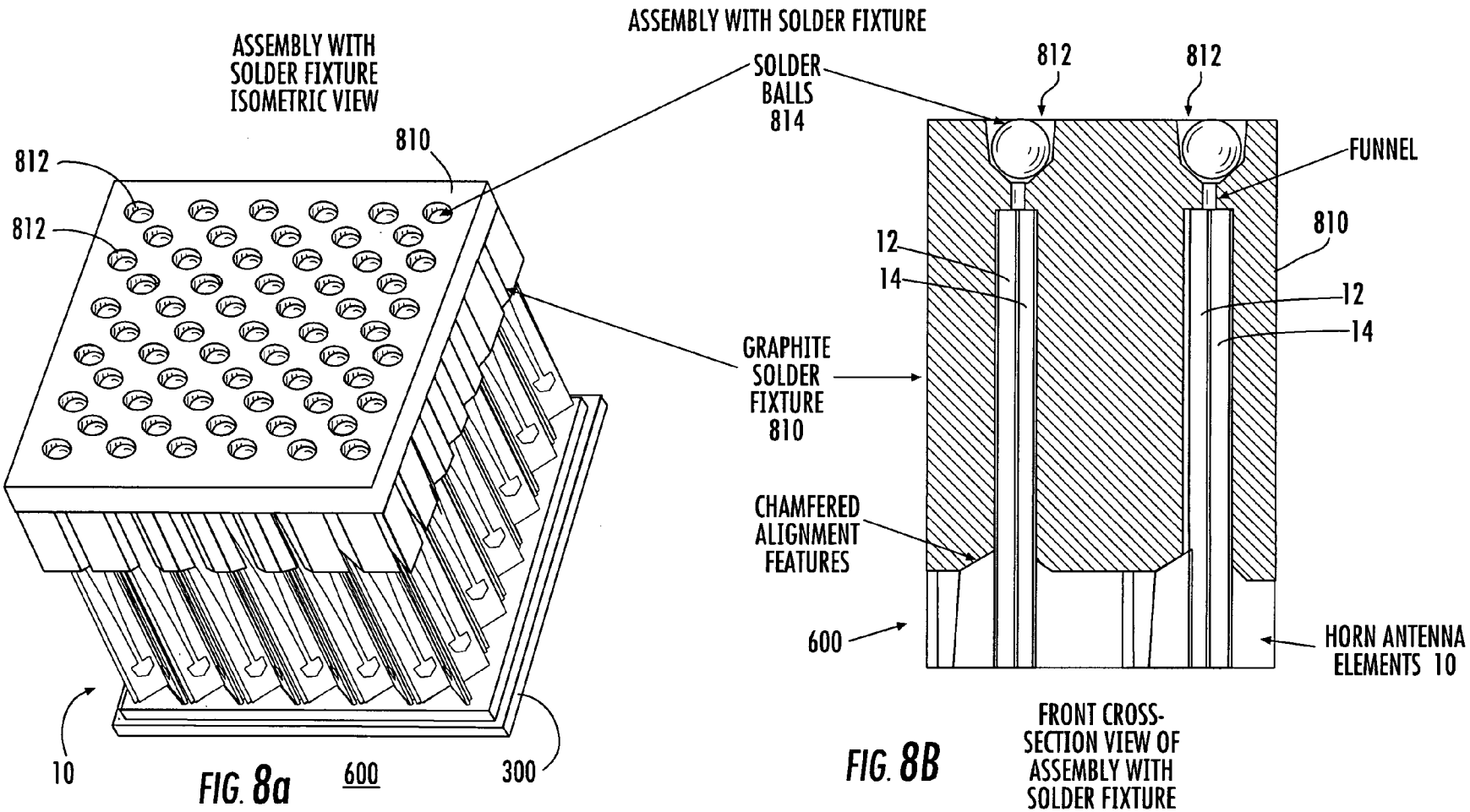
FIG. 8*a* is a top isometric view of the horn array antenna of FIG. 6 fitted with a solder fixture for holding the upper ends of the horn elements of the array in place during fusing or soldering.
FIG. 8*b* is a cross-section of the solder fixture of FIG. 8*a* to illustrate how solder balls can be placed therein for helping to prevent voids in the fused solder.

FIG. 8*a* is an isometric view of an array 600 of horn antennas 10 assembled onto a baseplate or ground plane 300, much as shown in FIG. 6, with the addition of a solder fixture 810 for holding the radiating ends of the horns of the array. For holding the radiating ends of the horns 10 of the array 600, solder fixture 810 is provided with mutually orthogonal or crossed slots, substantially equivalent to the antenna-receiving slots in the upper side of ground plane 300. These slots in the solder fixture mate with the boards of the various antennas 10 of the array, and hold them in fixed position at the top. Thus, the horn antennas 10 of the array 600 of FIG. 8*a* are held in proper position at both their tops and at their bottoms before soldering. In order to be most effective, it is desirable that the fixture 810 be readily removable after the soldering operation is finished, for which purpose the fixture 810 is made from a material, such as graphite, which resists wetting by the solder.

According to a further aspect of the invention, the antenna holding fixture 810 of FIG. 8*a* is fitted with reservoirs or means for holding solder balls. These solder balls provide a reservoir of molten solder during the reflow soldering operation to fill in any areas which might otherwise have solder gaps. In the arrangement of FIG. 8*a*, the reservoirs are illustrated as a set of apertures 812. These apertures are located over the "X" joint of each set of four juxtaposed horn antennas, most easily seen in FIGS. 5*c* and 5*d*. The reservoir apertures 812 communicate by way of funnel sections 814 with the upper portion of the juxtaposed horn antennas 10 of each set of four horn antennas, as illustrated in FIG. 8*b*. The heating associated with the reflow soldering is performed with the solder fixture 810 in place and with a ball of solder 814 in each reservoir 812. When the reflow temperature is reached, not only does the "tinning" solder melt, but so do the solder balls 814. Gravity and surface tension help the solder flow from the melted balls in the reservoirs 812 to help in filling the region between the juxtaposed steps 15 of the horn antennas 10 of the array 600.

After assembly of the horn antenna array 600 and making it monolithic, standard coaxial fittings, such as SMA fittings, or any other type, can be affixed to the apertures 300*a* and pins 410 from the bottom side 300*ls* of the ground plane 300.

In general, a method for making a horn antenna array according to an aspect of the invention includes the steps of making first and second equal-size printed-circuit half-horn-elements 12 and 14, and offset-juxtaposing element pairs to make horn elements 10 having a dielectric lip or step 15. A ground plane 300 defining mutually intersecting crossed slot sets S1, S2 is loaded with horn elements 10 with their lips 15 interlocking near the slot crossings, to define the horn antenna array 600. The horn elements can be fed by pins 410 extending through portions of the ground plane 300 and into an aperture 10*a* adjacent the feed elements of the horn elements 10. Electrical connections are made by fusion joining after the array 600 is assembled.

A method according to an aspect of the invention is for making a horn antenna (10). The method comprises the steps of fabricating a dielectric first board (14) defining first (14*dls*) and second (14*dus*) broad sides, and may define a board thickness (t), and also having at least a first transverse dimension (W) adjacent a feed end (14FE) of the first board (14). The first board (14) defines an electrically conductive horn (30) on the first broad side (14*dls*) thereof, and a feed structure (16,16*e*,18) on the second broad side (14*dus*) thereof adjacent the feed end (14FE) of the first board (14). The feed structure (16,16*e*,18) includes a strip conductor (16*e*) adjacent the feed end (14FE) of the first board (14). The method includes the step of fabricating a dielectric second board (12) defining first (12*dus*) and second (12*des*) broad sides, and possibly a board thickness (t), and also having at least the first transverse dimension (W) adjacent a feed end (12FE) of the second board (12). The second board (12) defines on the first broad side (12*dus*) thereof an electrically conductive horn (30) including a feed region (20) adjacent the feed end (12FE) of the second board (12). The second board (12) defines an aperture or slot (10*a*) which is registered with the strip conductor (16*e*) when the second broad side (14*dus*) of the first board (14) is offset-juxtaposed with the second broad side (12*dls*) of the second board (12). The second broad side (14*dus*) of the first board (14) is offset-juxtaposed with the second broad side (12*dls*) of the second board (12), with the strip conductor feed structure (16,16*e*,18) adjacent the aperture (10*a*), and an offset or step (15) between lateral edges of the first (14) and second (12) boards, to thereby generate a single horn element (10). The offset or step may be equal in magnitude to the thickness (t), so that each of the two edges of each board is offset from the edges of the other board by the thickness of one board (t). A particular mode of this method comprises the further step of affixing the offset-juxtaposed second broad side (14*dus*) of the first board (14) to the second broad side (12*dls*) of the second board (12). The step of affixing may include application of fluid adhesive substance, which may be a hardenable fluid adhesive substance such as curable resin, to at least one of the second broad side (14*dls*) of the first board (14) and to the second broad side (12*dls*) of the second board (12). The step of affixing the offset-juxtaposed second broad side (14*dls*) of the first board (14) to the second broad side (12*dls*) of the second board (12) may comprise the step of fusion-bonding the offset-juxtaposed second broad side (14*dls*) of the first board (14) to the second broad side (12*dls*) of the second board (12).

Another method according to an aspect of the invention for making a horn antenna (10) comprises the steps of procuring a dielectric first board (14) defining first (14*dls*) and second (14*dls*) broad sides and a board thickness (t), and also having at least a first transverse dimension (W) adjacent a feed end (14FE) of the first board (14). The first board (14) which is procured defines a conductive horn (30) on the first broad side (14*dls*) thereof and a feed structure (16,16*e*,18) on the second broad side (14*dls*) thereof adjacent the feed end (14FE) of the first board (14). The feed structure (16,16*e*,18) of the first board includes a strip conductor (16*e*) adjacent the feed end (14FE) of the first board (14). The method also includes the step of procuring a dielectric second board (12) defining first (12*dus*) and second (12*dls*) broad sides and a board thickness (t), and also having at least the first transverse dimension (W) adjacent a feed end (12FE) of the second board (12). The second board (12) defines on the first broad side (12*dus*) a conductive horn (30) including a feed region (20) adjacent the feed end (12FE) of the second board (12), and the second board (12) defines an aperture (10*a*) which is registered with the strip conductor (16*e*) when the second broad side (14*dus*) of the first board (14) is offset-juxtaposed with the second broad side (12*dls*) of the second board (12). The second broad side (14*dus*) of the first board (14) is juxtaposed with the second broad side (12*dls*) of the second board (12), with the strip conductor (16*e*) feed structure (16,16*e*,18) adjacent the aperture (10*a*), to thereby generate a horn element (10). An electrically conductive support plate (300) is procured, which defines first (300*us*) and second (300*ls*) broad surfaces, and a plurality of elongated slots (300S1,300S2) depressed below the first broad surface (300*us*). The plurality of slots (300S1, 300S2) includes first (300S1) and second (300S2) sets of slots, the directions of elongation of which are mutually orthogonal. The individual slots of the first (300S1) and second (300S2) sets each define a width accommodating the combined thicknesses of the first and second boards. The individual slots of the first (300S1) and second (300S2) sets are mutually parallel and are spaced apart by a dimension at least equal to the transverse dimension (W). The conductive support plate (300) further supports a plurality of electrically conductive pins (410) which are electrically insulated from the support plate (300). The pins extend at least partially through the support plate (300) between the first (300*us*) and second (300*ls*) broad sides, and projecting into the slots (300S1,300S2) at locations registered with the strip conductors (16*e*) when the horn elements (10) are mounted in the slots (300S1,300S2) in such a manner that the pins (410) lie adjacent the corresponding strip conductor (16*e*). The feed end (10FE) of the horn element (10) is inserted into a corresponding slot (300S1,300S2) of the conductive support plate (300) with the strip conductor (16*e*) registered to be adjacent the corresponding pin (410). The pin is electrically connected or bonded, as by fusing or soldering, to the strip conductor. In a particular mode of this method, the step of juxtaposing the second broad side (14*dus*) of the first board (14) with the second broad side (12*dls*) of the second board (12), with the strip conductor (16*e*) feed structure (16,16*e*, 18) adjacent the aperture (10*a*), to thereby generate a horn element (10), further comprises the step of bonding the second broad side (14*dus*) of the first board (14) with the second broad side (12*dls*) of the second board (12). In another mode of the method, the step of bonding comprises the step of application of the liquid state of an adhesive substance, which may be a curable resin.

A method according to an aspect of the invention is for making a horn array. The method comprises the steps of procuring a dielectric first board (14) defining first (14*dls*) and second (14*dus*) broad sides, a board thickness (t), and first (14*le*1) and second (14*le*2) lateral edges, and also having at least a first transverse dimension (W) between the lateral edges at a location adjacent a feed end (14FE) of the first board (14). The first board (14) defining an electrically conductive horn (30) on the first broad side thereof (14*dls*) and a feed structure (16,16*e*,18) on the second broad side (14*dus*) thereof adjacent the feed end (14FE) of the first board (14). The feed structure (16,16*e*,18) includes a strip conductor (16*e*) adjacent the feed end (14FE) of the first board (14). The method also includes the procuring of a dielectric second board (12) defining first (12*dus*) and second (12*dls*) broad sides, a board thickness (t), and first (12*le*1) and second (12*le*2) lateral edges, and also having at least the first transverse dimension (W) between those lateral edges adjacent a feed end (12FE) of the second board (12). The second board (12) defines on the first broad side (12*dus*)

a conductive horn (30) including a feed region (20) adjacent the feed end (12FE) of the second board (12). The second board (12) defines an aperture (10*a*) which is registered with the strip conductor (16*e*) when the second broad side (14*dls*) of the first board (14) is offset-juxtaposed with the second broad side (12*dls*) of the second board (12). The second broad side (14*dus*) of the first board (14) is offset-juxtaposed with the second broad side (12*dls*) of the second board (12), with the strip conductor (16*e*) feed structure (16,16*e*,18) adjacent the aperture (10*a*), and with the lateral edges offset by the thickness (t), to thereby generate a horn antenna (10) element. The steps of procuring a dielectric first board (14), procuring a dielectric second board (12), and offset-juxtaposing of the boards are repeated, until at least four horn antenna (10) elements are available. A conductive support plate (300) is procured, which defines first (300*us*) and second (300*ls*) broad surfaces, and a plurality of elongated slots (300S1,300S2) depressed below the first broad surface (300*us*). The plurality of slots (300S1,300S2) includes first (300S1) and second (300S2) sets of slots, the directions of elongation of which are mutually orthogonal. The individual slots of the first (300S1) and second (300S2) sets each define a width (sw) accommodating the combined thicknesses of the first (14) and second (12) boards of a horn antenna (10) element. The individual slots of the first (300S1) and second (300S2) sets are mutually parallel and spaced apart by a dimension about equal to the sum of the transverse dimension (W) plus the thickness (t) of one of the first (14) and second (12) boards. The conductive support plate (300) further supports a plurality of electrically conductive pins (410), each of which is electrically insulated from the support plate (300). The pins (410) extend at least partially through the support plate, between the first (300*us*) and second (300*ls*) broad sides, and project into the slots (300S1, 300S2) at locations registered with the strip conductors (16*e*) when the horn elements (10) are mounted in the slots (300S1,300S2) in such a manner that the pins (410) lie adjacent the corresponding strip conductor (16*e*). The feed ends (10FE) of at least first, second, third, and fourth of the horn antenna (10) elements are inserted into a pair of mutually orthogonal corresponding slots of the conductive support plate (300) with the strip conductors (16*e*) registered to be adjacent the corresponding pins (410) and with the offsets (15) of the first, second, third and fourth horn antenna (10) elements mating. The pins are electrically connected to the strip conductors.

Another method for making a horn array according to an aspect of the invention comprises the steps of procuring a dielectric first board (14) defining first (14*dls*) and second (14*dus*) broad sides, a board thickness (t), and first (14*le*1) and second (14*le*2) lateral edges, and also having at least a first transverse dimension (W) adjacent a feed end (14FE) of the first board (14), the first board (14) defining a conductive-slot horn (30) on the first broad side (14*dls*) thereof and a feed structure (16,16*e*,18) on the second broad side (14*dus*) thereof adjacent the feed end (14FE) of the first board (14). The feed structure (16,16*e*,18) includes a strip conductor (16*e*) adjacent the feed end (14FE) of the first board (14). A dielectric second board (12) is procured, which defines first (12*dus*) and second (12*dls*) broad sides, a board thickness (t), and first (12*le*1) and second (12*le*2) lateral edges, and which also defines at least the first transverse dimension (W) adjacent a feed end (12FE) of the second board (12). The second board (12) defines on the first broad side (12*dus*) thereof a conductive-slot horn (30) including a feed region (16,16*e*,18) adjacent the feed end (12FE) of the second board (12). The second board (12) defines an aperture (10*a*) which is registered with the strip conductor (16*e*) when the second broad side (14*dus*) of the first board (14) is offset-juxtaposed with the second broad side (12*des*) of the second board (12). This method also includes the step of offset-juxtaposing the second broad side (14*dus*) of the first board (14) with the second broad side (12*dls*)of the second board (12), with the strip conductor feed structure (16,16*e*, 18) adjacent the aperture (10*a*), and with the lateral edges offset by the thickness (t), to thereby generate a conductive-slot horn antenna (10) element defining a radiating end (10RE) opposite to the feed end (10FE). The steps of procuring a dielectric first board (14), procuring a dielectric second board (12), and offset-juxtaposing of the boards are repeated, until at least four horn antenna (10) elements are available. A conductive support plate (300) is procured, which defines first (300*us*) and second (300*ls*) broad surfaces, and a plurality of elongated slots (300S1,300S2) depressed below the first broad surface (300*us*). The plurality of slots (300S1,300S2) includes first (S1) and second (S2) sets of slots, the directions of elongation of which are mutually orthogonal. The individual slots of the first and second sets define a width accommodate the combined thicknesses of the first (14) and second (12) boards of a horn antenna (10) element. The individual slots of the first (S1) and second (S2) sets are mutually parallel and are spaced apart by a dimension about equal to the sum of the transverse dimension (W) plus the thickness (t) of one of the first (14) and second (12) boards. The conductive support plate (300) further supports a plurality of electrically conductive pins (410), which are electrically insulated from the support plate (300). The pins (410) extend at least partially through the plate (300) between the first (300*us*) and second (300*ls*) broad sides, and project into the slots (300S1,300S2) at locations registered with the strip conductors (16*e*) when the horn elements (10) are mounted in the slots (300S1,300S2) in such a manner that the pins (410) lie adjacent the corresponding strip conductors (16*e*). The feed end (10FE) of at least first, second, third, and fourth of the conductive-slot horn antenna elements (10) are inserted into a pair of mutually orthogonal corresponding slots of the conductive support plate (300), with the strip conductors (16*e*) registered to be adjacent the corresponding pins (410) and with the offsets of the first, second, third and fourth horn antenna elements (10) mating or interlocked. The pins are electrically connected to the strip conductors and the conductive portions of the conductive slot horns are electrically connected to adjacent ones of the conductive portions of the conductive slot horns, to thereby define an antenna array including two pairs of mutually orthogonal conductive horn (30) antenna (10) elements. In a particular mode of this method for making an array, a further step is performed between the steps of inserting the feed end (10FE) of a horn element (10) and electrically connecting pins, which includes affixing a jig (810) to the radiating end of the conductive horn (30) antenna elements (10) to hold the radiating ends (10RE) of the horn antenna elements (10) in the same dimensional relationship as that provided to the feed ends (10FE) by the slots (300S1,300S2) of the support plate (300). In a particularly desirable mode of this method, the jig includes a material, such as graphite, which is not wetted by a fusion material, and the step of electrically connecting further comprises the step of heating the two pairs of mutually orthogonal conductive horn antenna (10) elements and the conductive support plate (300) in the presence of fusion material, such as solder. Ideally, the steps of (a) procuring a dielectric first board (12), (b) procuring a dielectric second board (12), (c) offset-juxtaposing to thereby generate a conductive-slot horn antenna element (10), (d) repeating, (e) procuring a conductive support plate, and (f) inserting the feed end (10FE) are repeated, until slot locations having the pins are all populated, and only when all slot locations are so populated performing the step of electrically connecting.

What is claimed is:

1. A method for making a horn antenna, said method comprising the steps of:

fabricating a dielectric first board defining first and second broad sides, and also having at least a first transverse dimension adjacent a feed end of said first board, said first board defining a conductive horn on said first broad side thereof and a feed structure on said second broad side thereof adjacent said feed end of said first board, said feed structure including a strip conductor adjacent said feed end of said first board;

fabricating a dielectric second board defining first and second broad sides, and also having at least said first transverse dimension adjacent a feed end of said second board, said second board defining on said first broad side a conductive horn including a feed region adjacent said feed end of said second board, said second board defining an aperture which is registered with said strip conductor when said second broad side of said first board is offset-juxtaposed with said second broad side of said second board;

offset-juxtaposing said second broad side of said first board with said second broad side of said second board, with said strip conductor feed structure adjacent said aperture, and an offset between lateral edges of said first and second boards, to thereby generate a single horn element.

2. A method according to claim 1, wherein:

said dielectric first and second boards have the same thickness, and said offset between lateral edges of said first and second boards is equal in magnitude to the thickness of one of said first and second boards.

3. A method according to claim 2, further comprising the step of affixing said offset-juxtaposed second broad side of said first board to said second broad side of said second board.

4. A method according to claim 3, wherein said step of affixing includes application of fluid adhesive substance to at least one of said second broad side of said first board to said second broad side of said second board.

5. A method according to claim 4, wherein said step of application of fluid adhesive substance includes the step of application of a hardenable fluid adhesive substance.

6. A method according to claim 5, wherein said step of application of a hardenable fluid adhesive substance includes the step of application of a curable resin.

7. A method according to claim 3, wherein said step of step of affixing said offset-juxtaposed second broad side of said first board to said second broad side of said second board comprises the step of fusion-bonding said offset-juxtaposed second broad side of said first board to said second broad side of said second board.

8. A method for making a horn antenna, said method comprising the steps of:

procuring a dielectric first board defining first and second broad sides and a board thickness, and also having at least a first transverse dimension adjacent a feed end of said first board, said first board defining a conductive horn on said first broad side thereof and a feed structure on said second broad side thereof adjacent said feed end of said first board, said feed structure including a strip conductor adjacent said feed end of said first board;

procuring a dielectric second board defining first and second broad sides and a board thickness, and also having at least said first transverse dimension adjacent a feed end of said second board, said second board defining on said first broad side a conductive horn including a feed region adjacent said feed end of said second board, said second board defining an aperture which is registered with said strip conductor when said second broad side of said first board is offset-juxtaposed with said second broad side of said second board;

juxtaposing said second broad side of said first board with said second broad side of said second board, with said strip conductor feed structure adjacent said aperture, to thereby generate a horn element;

procuring a conductive support plate defining first and second broad surfaces, and a plurality of elongated slots depressed below said first broad surface, said plurality of slots including first and second sets of slots, the directions of elongation of which are mutually orthogonal, the individual slots of said first and second sets defining a width accommodating the combined thicknesses of said first and second boards, said individual slots of said first and second sets being mutually parallel and spaced apart by a dimension at least equal to said transverse dimension, said conductive support plate further supporting a plurality of electrically conductive pins, electrically insulated from said support plate, said pins extending at least partially through said plate between said first and second broad sides, and projecting into said slots at locations registered with said strip conductors when said horn elements are mounted in said slots in such a manner that said pins lie adjacent the corresponding strip conductor;

inserting the feed end of said horn element into a corresponding slot of said conductive support plate with said strip conductor registered to be adjacent the corresponding pin; and electrically connecting said pin to said strip conductor.

9. A method according to claim 8, wherein said step of juxtaposing said second broad side of said first board with said second broad side of said second board, with said strip conductor feed structure adjacent said aperture, to thereby generate a horn element, further comprises the step of bonding said second broad side of said first board with said second broad side of said second board.

10. A method according to claim 9, wherein said step of bonding comprises the step of fusion bonding.

11. A method according to claim 9, wherein said step of bonding comprises the step of application of the liquid state of an adhesive substance.

12. A method according to claim 11, wherein said step of application of the liquid state of an adhesive substance comprises the step of application of the liquid state of a curable resin.

13. A method for making a horn array, said method comprising the steps of:

procuring a dielectric first board defining first and second broad sides, a board thickness, and first and second lateral edges, and also having at least a first transverse dimension adjacent a feed end of said first board, said first board defining a horn on said first broad side thereof and a feed structure on said second broad side thereof adjacent said feed end of said first board, said feed structure including a strip conductor adjacent said feed end of said first board;

procuring a dielectric second board defining first and second broad sides, a board thickness, and first and second lateral edges, and also having at least said first transverse dimension adjacent a feed end of said second board, said second board defining on said first broad side a horn including a feed region adjacent said feed end of said second board, said second board defining an aperture which is registered with said strip conductor when said second broad side of said first board is offset-juxtaposed with said second broad side of said second board;

offset-juxtaposing said second broad side of said first board with said second broad side of said second board, with said strip conductor feed structure adjacent said aperture, and with the lateral edges offset by said thickness, to thereby generate a horn antenna element;

repeating said steps of procuring a dielectric first board, procuring a dielectric second board, and offset-juxtaposing of said boards, until at least four horn antenna elements are available;

procuring a conductive support plate defining first and second broad surfaces, and a plurality of elongated slots depressed below said first broad surface, said plurality of slots including first and second sets of slots, the directions of elongation of which are mutually orthogonal, the individual slots of said first and second sets defining a width accommodating the combined thicknesses of said first and second boards of a horn antenna element, said individual slots of said first and second sets being mutually parallel and spaced apart by a dimension about equal to the sum of said transverse dimension plus said thickness of one of said first and second boards, said conductive support plate further supporting a plurality of electrically conductive pins, electrically insulated from said support plate, said pins extending at least partially through said plate between said first and second broad sides, and projecting into said slots at locations registered with said strip conductors when said horn elements are mounted in said slots in such a manner that said pins lie adjacent the corresponding strip conductor;

inserting the feed end of at least first, second, third, and fourth of said horn antenna elements into a pair of mutually orthogonal corresponding slots of said conductive support plate with said strip conductors registered to be adjacent the corresponding pins and with said offsets of said first, second, third and fourth horn antenna elements mating; and electrically connecting said pins to said strip conductors.

14. A method for making a horn array, said method comprising the steps of:

procuring a dielectric first board defining first and second broad sides, a board thickness, and first and second lateral edges, and also having at least a first transverse dimension adjacent a feed end of said first board, said first board defining a conductive-slot horn on said first broad side thereof and a feed structure on said second broad side thereof adjacent said feed end of said first board, said feed structure including a strip conductor adjacent said feed end of said first board;

procuring a dielectric second board defining first and second broad sides, a board thickness, and first and second lateral edges, and also having at least said first transverse dimension adjacent a feed end of said second board, said second board defining on said first broad side a conductive-slot horn including a feed region adjacent said feed end of said second board, said second board defining an aperture which is registered with said strip conductor when said second broad side of said first board is offset-juxtaposed with said second broad side of said second board;

offset-juxtaposing said second broad side of said first board with said second broad side of said second board, with said strip conductor feed structure adjacent said aperture, and with the lateral edges offset by said thickness, to thereby generate a conductive-slot horn antenna element defining a radiating end opposite to said feed end;

repeating said steps of procuring a dielectric first board, procuring a dielectric second board, and offset-juxtaposing of said boards, until at least four horn antenna elements are available;

procuring a conductive support plate defining first and second broad surfaces, and a plurality of elongated slots depressed below said first broad surface, said plurality of slots including first and second sets of slots, the directions of elongation of which are mutually orthogonal, the individual slots of said first and second sets defining a width accommodating the combined thicknesses of said first and second boards of a horn antenna element, said individual slots of said first and second sets being mutually parallel and spaced apart by a dimension about equal to the sum of said transverse dimension plus said thickness of one of said first and second boards, said conductive support plate further supporting a plurality of electrically conductive pins, electrically insulated from said support plate, said pins extending at least partially through said plate between said first and second broad sides, and projecting into said slots at locations registered with said strip conductors when said horn elements are mounted in said slots in such a manner that said pins lie adjacent the corresponding strip conductor;

inserting the feed end of at least first, second, third, and fourth of said conductive-slot horn antennas elements into a pair of mutually orthogonal corresponding slots of said conductive support plate with said strip conductors registered to be adjacent the corresponding pins and with said offsets of said first, second, third and fourth horn antenna elements mating; and electrically connecting said pins to said strip conductors and said conductive portions of said conductive slot horns to adjacent ones of said conductive portions of said conductive slots, to thereby define an array including two pairs of mutually orthogonal conductive horn antenna elements.

15. A method according to claim 14, further comprising, between said steps of inserting the feed end and electrically connecting, the step of:

affixing a jig to said radiating end of said conductive horn antenna elements to hold the radiating ends of said horn antenna elements in the same dimensional relationship as that provided to said feed ends by said slots of said support plate.

16. A method according to claim 14, wherein said jig includes a material which is not wetted by a fusion material, and wherein said step of electrically connecting further comprises the step of heating said two pairs of mutually orthogonal conductive horn antenna elements and said conductive support plate in the presence of fusion material.

17. A method according to claim 16, wherein said fusion material is solder, and said material is graphite.

18. A method according to claim 14, further comprising repeating said steps of (a) procuring a dielectric first board, (b) procuring a dielectric second board, (c) offset-juxtaposing to thereby generate a conductive-slot horn antenna element, (d) repeating, (e) procuring a conductive support plate, and (f) inserting the feed end, until slot locations having said pins are all populated, and only when all slot locations are so populated performing said step of electrically connecting.

19. A method for making a horn antenna comprises the steps of:

procuring a planar horn antenna defining a planar feed conductor located within an aperture adjacent the feed end of said horn antenna;

procuring an electrically conductive support structure defining an elongated slot having sides and a bottom, said sides and bottom being dimensioned to accommodate said feed end of said horn antenna, said support structure further defining an electrically conductive coaxial conductor extending in an electrically insulated manner through said support structure, and having a portion of said coaxial conductor extending outwardly from the bottom of said slot;

mounting said planar horn antenna in said slot with said portion of said coaxial conductor extending into said aperture adjacent said feed conductor; and making an electrical connection between said portion of said coaxial conductor and said planar feed conductor.

* * * * *

UNITED STATES PATENT AND TRADEMARK OFFICE

CERTIFICATE OF CORRECTION

PATENT NO. : 7,193,578 B1
APPLICATION NO. : 11/245831
DATED : March 20, 2007
INVENTOR(S) : Daniel W. Harris and Joseph W. Hahn It is certified that error appears in the above-identified patent and that said Letters Patent is hereby corrected as shown below:

Column 1, line 7, replace contract number "SOMA 1TL391S01T00" with -- N00014-02-C-0474 --.

Signed and Sealed this

Thirteenth Day of May, 2008

JON W. DUDAS
*Director of the United States Patent and Trademark Office*